US009874344B2

(12) United States Patent
Green

(10) Patent No.: US 9,874,344 B2
(45) Date of Patent: Jan. 23, 2018

(54) ACCENT LIGHTING FOR DEMOUNTABLE WALL SYSTEM

(71) Applicant: Krueger International, Inc., Green Bay, WI (US)

(72) Inventor: Shawn D. Green, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 242 days.

(21) Appl. No.: 14/261,522

(22) Filed: Apr. 25, 2014

(65) Prior Publication Data

US 2014/0334136 A1 Nov. 13, 2014

Related U.S. Application Data

(60) Provisional application No. 61/822,082, filed on May 10, 2013.

(51) Int. Cl.

| | |
|---|---|
| ***F21V 33/00*** | (2006.01) |
| *F21Y 103/10* | (2016.01) |
| *F21Y 115/10* | (2016.01) |

(52) U.S. Cl.

CPC ..... *F21V 33/006* (2013.01); *F21Y 2103/10* (2016.08); *F21Y 2115/10* (2016.08)

(58) Field of Classification Search

CPC ..... F21Y 2101/02; F21Y 2103/003; F21Y 2105/001; F21Y 2103/10; F21Y 2115/10; F21V 33/006

USPC ..... 362/148, 150, 151, 153, 147

See application file for complete search history.

(56) References Cited

U.S. PATENT DOCUMENTS

| | | | | |
|---|---|---|---|---|
| 4,939,627 | A * | 7/1990 | Herst | F21V 5/02 362/147 |
| 7,348,736 | B2 | 3/2008 | Piepgras et al. | |
| 7,607,812 | B2 | 10/2009 | Kim | |
| 8,235,554 | B2 | 8/2012 | Steinkraus | |
| 2005/0207166 | A1* | 9/2005 | Kan | F21S 48/328 362/373 |
| 2008/0151536 | A1* | 6/2008 | Hess | F21V 33/006 362/224 |
| 2010/0165606 | A1* | 7/2010 | Paterson | F21V 33/006 362/147 |

(Continued)

FOREIGN PATENT DOCUMENTS

WO 2013/030814 A2 3/2013

*Primary Examiner* — Sean Gramling
*Assistant Examiner* — Gerald J Sufleta, II
(74) *Attorney, Agent, or Firm* — Andrus Intellectual Property Law, LLP

(57) ABSTRACT

A demountable Wall system that includes a base trim that receives an accent lighting assembly. The lower trim of the demountable wall system includes one or more lighting base trim sections that receive an accent lighting assembly. The accent lighting assembly includes an extruded diffuser formed from a transparent plastic material. The diffuser receives a light strip having a series of spaced LED lights each positioned to project light through a curved, projection wall of the diffuser. When the accent lighting assembly is mounted to the lighting base trim member, the accent lighting assembly projects light downward toward the floor and onto an angled face wall of the lighting base trim member. The lighting base trim member can selectively replace decorative base trim members of the demountable wall system.

8 Claims, 4 Drawing Sheets

(56) References Cited

U.S. PATENT DOCUMENTS

2010/0313498 A1* 12/2010 Paidar ..... E04F 19/0436
52/173.1
2014/0069030 A1* 3/2014 Boissevain ..... F21V 33/006
52/28

* cited by examiner 12
76
76
24
70
72
94
62
74
74
84
80
71
78
92
82
28
96
42
48
40
58
36
26
50
50
44
54
54
44
52
52
32
56
46
38
56

12
76
76
24
70
70
62
64
72
72
66
71
71
90
84
86
60
68
78
88
92
96
80
82
48
42
58
40
26
50
50
54
54
52
52
56
56
44
44
46

ACCENT LIGHTING FOR DEMOUNTABLE WALL SYSTEM

CROSS-REFERENCE TO RELATED APPLICATION

The present application is based on and claims priority to U.S. Provisional Patent Application Ser. No. 61/822,082 filed May 10, 2013, the disclosure of which is incorporated herein by reference.

BACKGROUND

The present disclosure generally relates to a wall panel system. More specifically, the present disclosure relates to a system that incorporates accent lighting into a demountable wall system (DWS) that uses tempered or laminated glass as the primary exposed surface and the primary structural element.

Panel-type wall systems are commonly used to divide space in an open-plan office environment. In a typical modular panel-type wall system, a number of wall panels are interconnected together in a configuration suitable for the intended use of the space. Each wall panel typically includes a structural frame to which a pair of tiles are mounted. The tiles may be broadly classified as either decorative tiles or functional tiles. Decorative tiles have an acoustic insulating material covered by an appropriate finishing material such as fabric, metal or wood and are designed to provide sound proofing and aesthetic appearance. Functional tiles generally have a the frame that supports functional components, such as a tool rail, one or more hooks, an opening, a window, a shelf, a marker board, paper management components, etc.

The large number of panel-type wall systems currently available allow a business owner to divide an open space into a series of enclosed areas. Although panel-type wall systems. are commonly available, the solid surfaces used in most panel systems create an enclosed area that may not have any exterior windows or any other types of glass areas open to allow light to enter into the enclosed area.

Presently, modular wall systems have been developed that include glass panels as the structural elements rather than just as windows within a typical panel system. The demountable wall systems that use tempered or laminated glass as the primary exposed surface increase the amount of light that reaches into the enclosed area defined by the wall panel. However, utilizing glass panels instead of solid, structural panels creates certain challenges since structural components of the panel systems are viewable through the glass panel members.

The mountable wall systems include a great deal of flexibility that allow business owners to tailor the wall system to their particular requirements. The advent of wall systems that include primarily glass panels increases the aesthetic desirability of the wall system. The various different types of configurations allows for different types of lighting systems to be used within the wall system. The present disclosure incorporates accent lighting near the base of the wall system to enhance the aesthetic look of the wall system.

SUMMARY

The present disclosure relates to a demountable wall system. More specifically, the present disclosure relates to the use of a lower trim section on the wall system that includes accent lighting.

The demountable modular wall system of the present disclosure is designed for use in a building having a floor and a ceiling. The modular wall system includes a series of individual wall panels that each include a top end and a bottom end. In one embodiment of the disclosure, the bottom end of each wall panel is supported by a height adjustment assembly that is secured to a floor channel mounted to the floor of the building.

The wall system further includes a lighting base trim member that is positioned to conceal the space between the bottom end of the wall panel and the floor. The lighting base trim member thus provides for a visually pleasing appearance at the intersection between the wall panel and the floor and allows for the height adjustment of the wall panels.

The modular wall system further includes an accent lighting assembly that is mounted to the lighting base trim member. The accent lighting assembly can be activated to create accent lighting to further enhance the overall appearance of the demountable wall system.

The accent lighting assembly includes a diffuser that is formed from a transparent plastic material. The diffuser includes a pair of back walls joined to each other by a curved projection wall. The combination of the back walls and the curved projection wall define an open interior that extends along the length of the diffuser. The open interior receives a light strip that includes a plurality of spaced LED lights mounted to a backing strip. When activated, the LED lights create a source of light that projects through the projection surface formed as part of the diffuser.

In one embodiment of the disclosure, the demountable modular will system can include a decorative base trim mounted on an opposite side of the wall panel from the lighting base trim. Both the decorative base trim member and the lighting base trim member are mounted to the floor channel and are positioned to enhance the overall appearance of the modular wall system.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
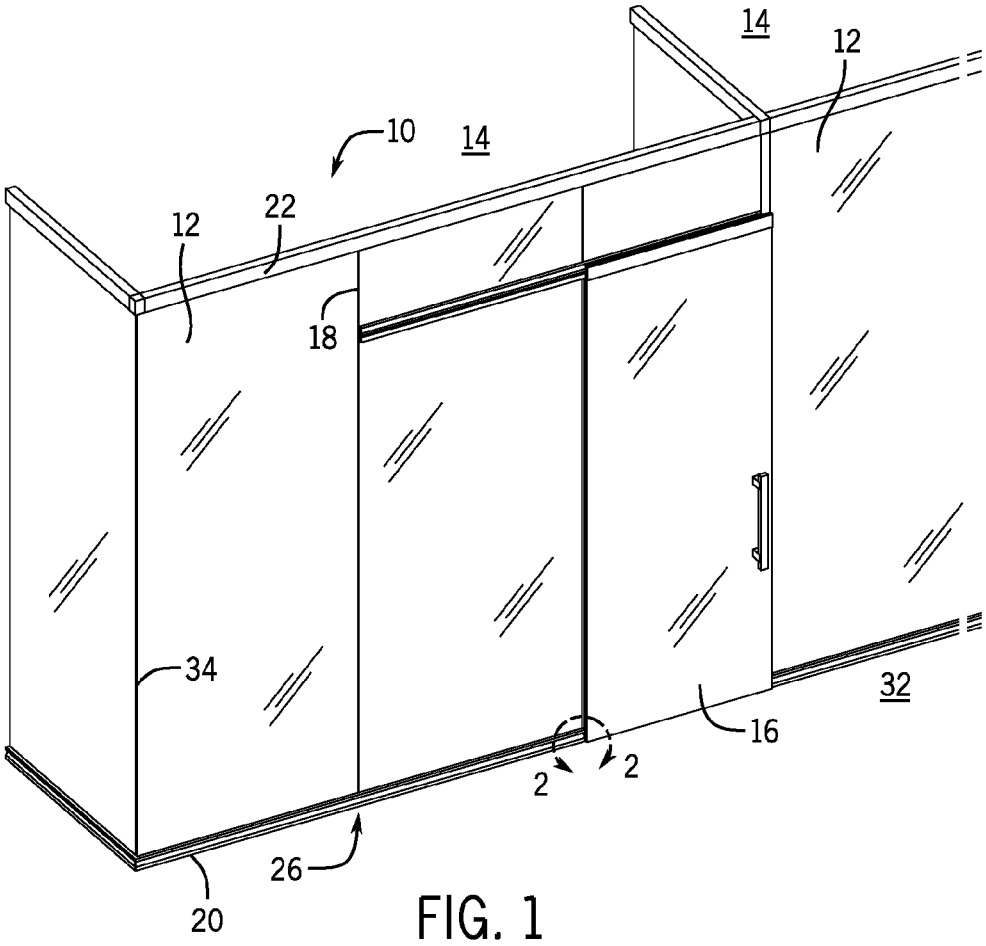
FIG. 1 is a perspective view of a demountable wall system incorporating the accent lighting of the present disclosure.

FIG. 1 illustrates a demountable wall system (DWS) 10 constructed in accordance with the present disclosure. The wall system 10 shown in FIG. 1 includes multiple glass wall panels 12 that can be used with conventional wall panels or with each other to create multiple rooms 14.

In the embodiment shown in FIG. 1, the wall system 10 includes a sliding door 16 that can be used to selectively expose a doorway to enter into one of the rooms 14. In the embodiment shown in FIG. 1, the adjacent wall panels 12 abut each other to create a panel joint 18. The panel joint is a butt-glazed joint in which one of the side edges of the adjacent wall panels includes a bulb seat that creates A seal between the pair of adjacent wall panels at the panel joint 18.

As illustrated in FIG. 1, the demountable wall system 10 includes a lower trim and an Upper trim 22 that enhance the overall aesthetic appearance of the demountable wall system 10. In the embodiment shown in FIG. 1, both the lower trim 20 and the upper trim 22 extend across multiple glass wall panels. The upper and lower trim sections 20, 22 are installed after the construction of the demountable wall system 10 and provide a visually appealing appearance for the wall system 10. The upper and lower trim sections cover the gap between the wall panels and the ceiling and floor as the height of the wall panels are adjusted to compensate for an uneven floor.

Figure 2:
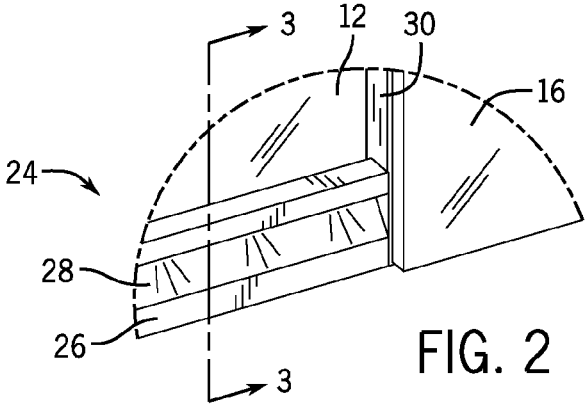
FIG. 2 is a magnified view of the accent lighting taken along line 2-2 of FIG. 1.

FIG. 2 illustrates the accent lighting system 24 constructed in accordance with the present disclosure. The accent lighting system 24 generally includes a lighting base trim member 26 that is mounted to cover the gap that exists between the bottom end of each of the glass panels 12 and the floor. As illustrated in FIG. 2, the accent lighting system 24 includes a series of accent lights that create a source of light directed onto the floor, as illustrated by reference number 28 shown in FIG. 2.

In the embodiment shown in FIG. 2, the lighting base trim member 26 abuts a vertical support 30 that defines part of the doorway covered by the sliding glass door 16. As can be understood in FIG. 1, the lighting base trim member 26 extends along the intersection between the series of glass wall panels 12 and the floor 32. The lighting base trim member 26 may be formed from either a single, unitary section or from a series of individual extruded sections that are positioned end-to-end to run along the entire length of each of the continuous walls that are formed by the series of adjacent glass wall panels 12. The lighting base trim member 26 may also extend around the corner 34. It is contemplated that the lighting base trim member 26 will be used on all of the exterior surfaces of the rooms formed by the demountable wall system 10. However, it should be understood that the lighting base trim member 26 can be utilized at any location in which it is desired to have a source of accent lighting for the demountable wall system 10.

Figure 3:
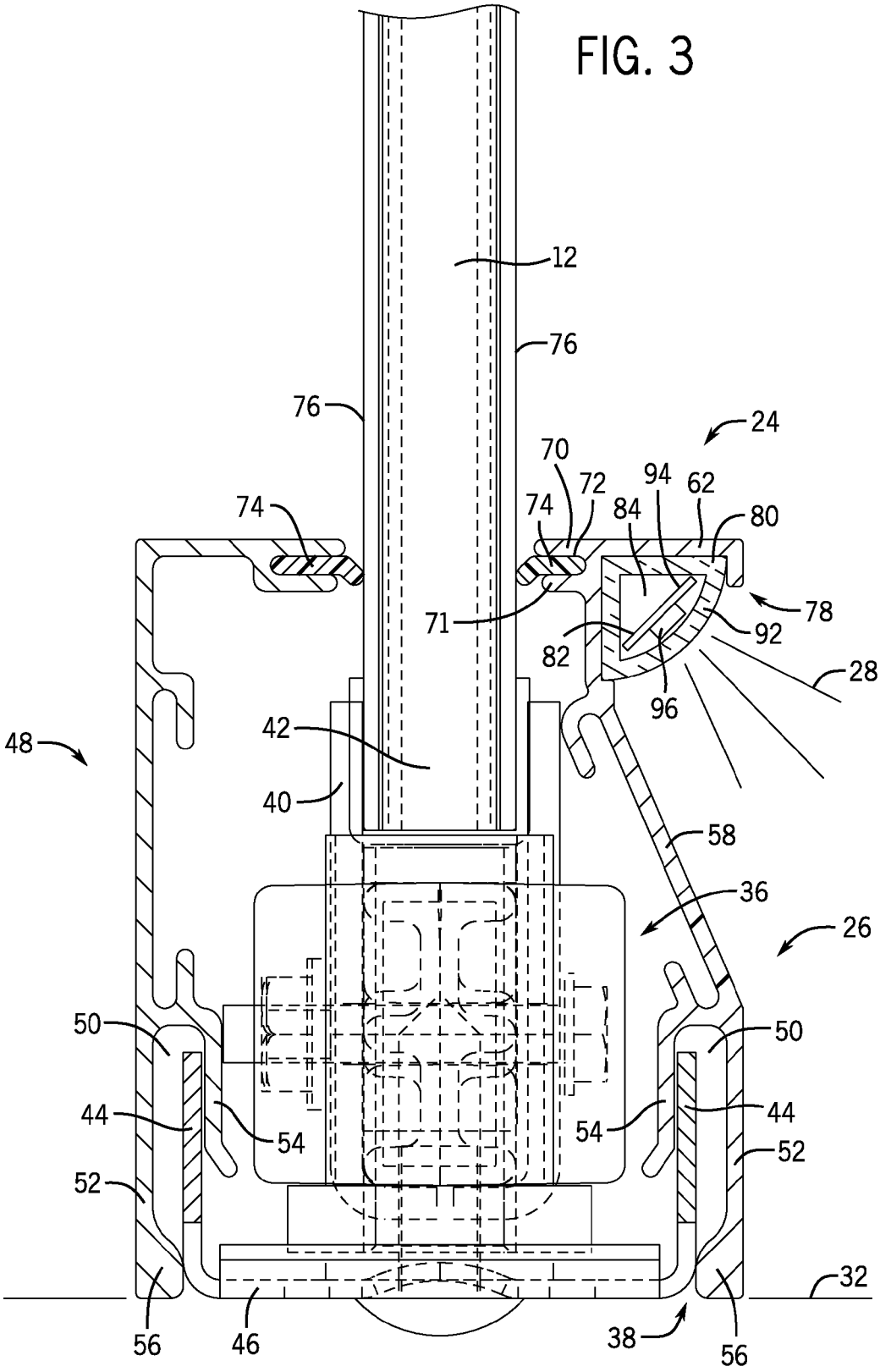
FIG. 3 is a section view taken along line 3-3 of FIG. 2.
Figure 4:
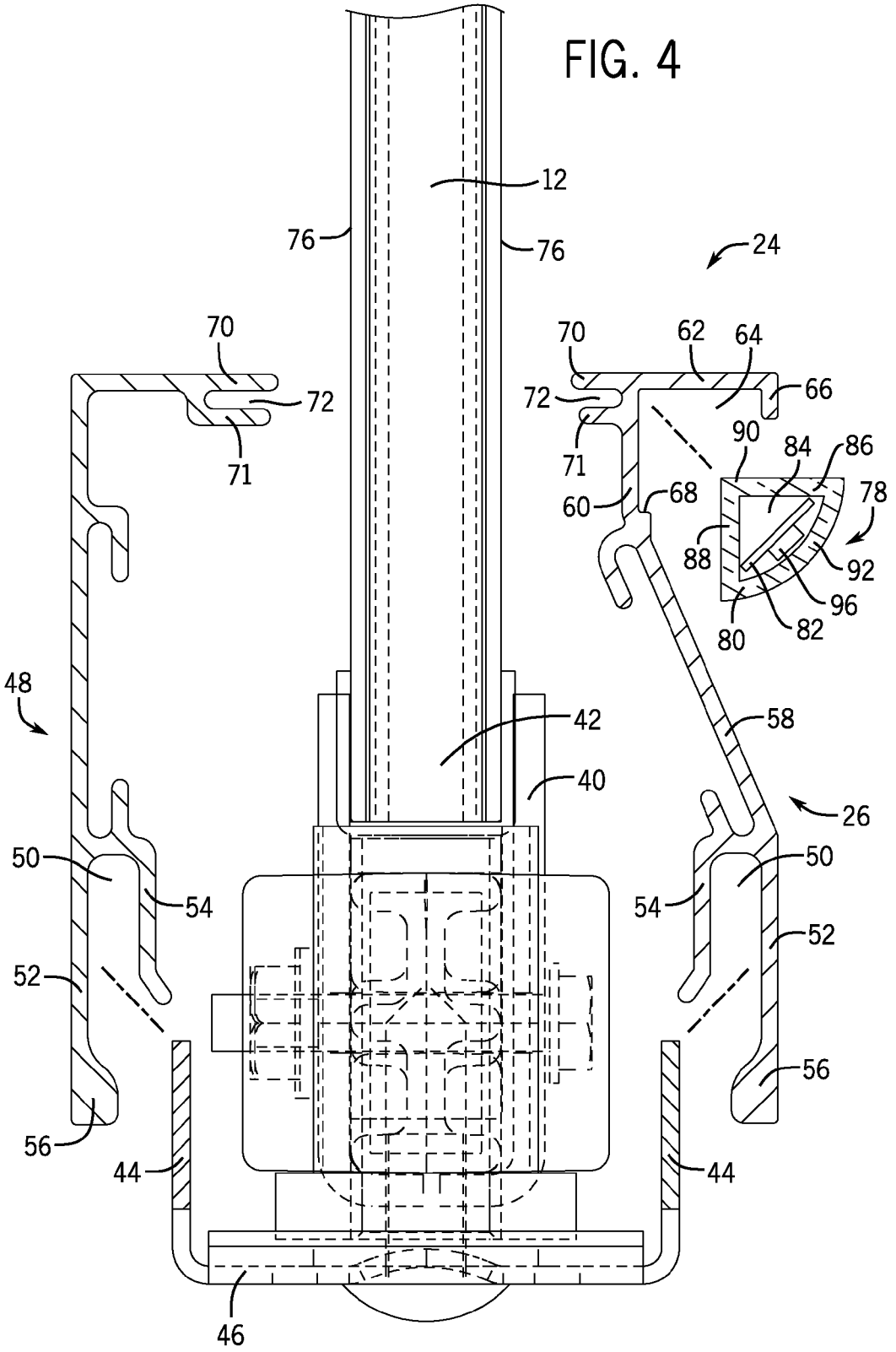
FIG. 4 is an exploded section view of the section shown in FIG. 3.

FIGS. 3 and 4 are similar section views and will be described together. As shown in FIG. 3, one of the glass wall panels 12 is shown supported by a height adjustment assembly 36. The height adjustment assembly 36 is operable to adjust the height of the wall panel 12 from the floor 32 to compensate for an uneven floor. The height adjustment assembly 36 is mounted to a floor channel 38. It should be understood that the height adjustment assembly 36 could take one of many different forms. In the embodiment shown, the height adjustment assembly 36 includes a receiving cradle 40 that receives a bottom end 42 of the wall panel 12.

The floor channel 38 is a metallic component securely mounted to the floor 32 and includes a pair of side flanges 44 that each extend vertically from a generally horizontal base 46 that is supported by the floor 32. The entire floor channel 38 is a conventional component utilized in many different demountable wall systems. FIGS. 3 and 4 illustrate two different types of lower trims that can be utilized as part of the demountable wall system of the present disclosure.

In the embodiment shown in FIG. 3, the left side of the wall panel 12 includes a decorative base trim member 48 while the right side includes the lighting base trim member 26. The decorative base trim member 48 and the lighting base trim member 26 include different overall configurations but are each mounted to the floor channel 38 in a similar mariner. Specifically, both the decorative base trim member 4$ and the lighting trim base member 26 include an open channel 50 defined between an outer wall 52 and an inner support flange 54. As shown in the Figures, the lowermost portion of the outer wall 52 includes a protruding portion 56 formed at the bottom end. The protruding portion 56 contacts one of the side flanges 44 of the floor channel 38 such that the side flange 44 is entrapped between the outer wall 52 and the support flange 54.

As illustrated in FIGS. 3 and 4, the lighting base trim member 26 includes an angled base wall 58 that extends between the generally vertical outer wall 52 and a generally vertical upper wall 60. The upper wall 60 is joined to a generally horizontal flange 62. The combination of the upper wall 60 and the horizontal flange 62 defines an open receiving cavity 64. As illustrated in FIG. 4, the open receiving cavity 64 is open in a generally downward and outward direction. The horizontal flange 62 further includes a vertical lip 66. A support shoulder 68 is defined at the point of intersection between the base wall 58 and the vertical upper wall 60. In this manner, the support shoulder 6$ and the lip 66 help to define the open receiving cavity 64.

As can be understood in FIGS. 3 and 4, the upper wall 60 includes a pair of extending flanges 70, 71 that define an open slot 72. The open slot 72 receives a wiper 74 formed from a resilient material, such as silicone or rubber, that engages an outer surface 76 of the glass panel 12 as the height of the glass wall panel 12 is adjusted.

In the embodiment illustrated, the entire lighting base trim member 26 is formed from an extruded material, such as aluminum. The extruded aluminum lighting base trim member 26 can be formed in various different lengths depending upon the type of rooms being configured by the end user. It is contemplated that the lighting base trim member 26 will be sold in predefined lengths and that sections of the lighting base trim member can be positioned adjacent to each other if longer lengths of the lower trim are needed.

The accent lighting system 24 of the present disclosure further includes an accent lighting assembly 78 that is mounted to the lighting base trim member 26 and positioned to direct light toward the floor 32, as illustrated by reference numeral 28 in FIG. 3.

As illustrated in FIG. 4, the accent lighting assembly 78 includes a diffuser 80 and a light strip 82. The light strip 82 is mounted within an open interior 84 defined by the diffuser 80. Specifically, the diffuser 80 includes a pair of back walls 86, 88 that are perpendicular to each other and define a corner 90. The opposite ends of the back walls 86, 88 are joined by a curved projection wall 92. In the embodiment shown in FIG. 4, the back walls 86, 88 have the same length and the projection wall 92 extends over 90° from the back wall 86 to the back wall 88.

In the embodiment shown in FIGS. 3 and 4, the entire diffuser 80 is formed from an extruded plastic material that is transparent. The transparent plastic material that forms the diffuser 80 allows light from the light strip 82 to pass therethrough and be projected toward the floor 32.

Figure 6:
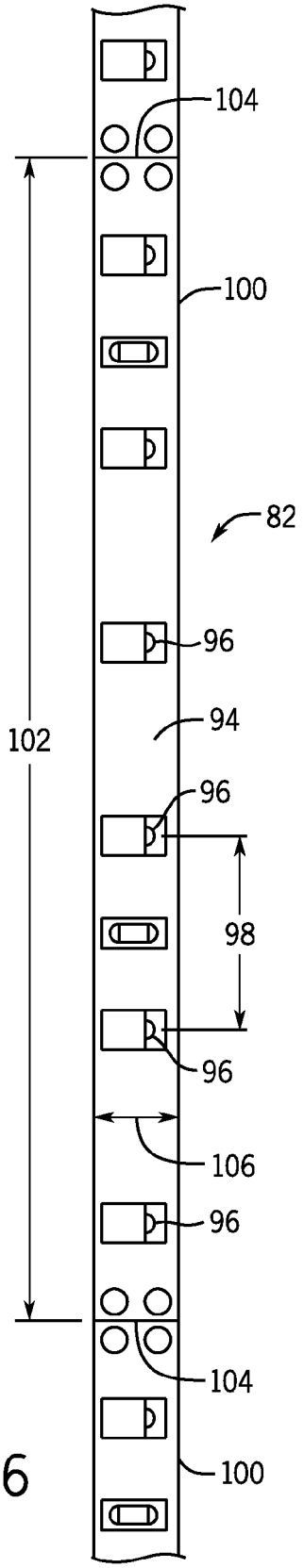
FIG. 6 is a top view of a strip of LED lighting utilized in accordance with the present disclosure.

FIG. 6 illustrates one embodiment of the light strip 82 of the present disclosure. Although one embodiment of the light strip 82 is shown in FIG. 6, it should be understood that various different other light strips could be utilized while operating within the scope of the present disclosure.

As shown in FIG. 6, the light strip includes a backing strip 94 that includes a series of electrical wires that connect a plurality of individual LED lights 96 that are spaced from each other along the backing strip at a distance 98. The distance 98 between each of the LED lights 96 can be varied depending upon the amount of accent lighting desired by an end user.

In the embodiment shown in FIG. 6, the light strip 82 is formed from multiple sections 100 each having a length shown by arrow 102. The separate sections can be joined to each other to adjust the overall length of the light strip 82. A junction point 104 is shown in FIG. 6 between the multiple sections 100. In the embodiment shown in FIG. 6, the light strip 82 has a width shown by arrow 106. The width 106 of the light strip 82 must be sufficiently small such that the backing material 94 fits within the open interior 84 of the diffuser 80 as shown. When the light strip 82 is positioned as shown in FIGS. 3 and 4, each of the LED lights 96 faces outward toward the projection wall 92 such that the LED lights 96 direct light as shown. Since the face wall 58 is angled, a portion of the projected light falls upon the face wall 58 to provide a visually pleasing appearance for the lower portion of the demountable wall system.

Figure 5:
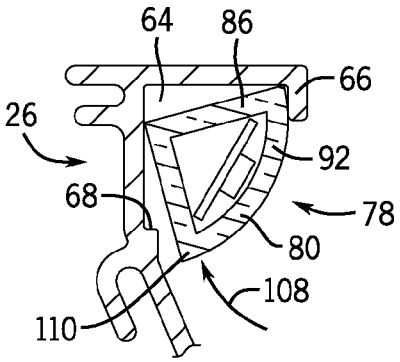
FIG. 5 is a magnified section view showing the installation of a section of light strip into the view trim.

During construction of the accent lighting assembly 78, the diffuser 80 is initially cut to its desired length. Once the length of the diffuser 80 has been created, the light strip 82 shown in FIG. 6 is assembled from the multiple sections 100. Once the desired length of the light strip 82 is created, the length of the light strip 82 is fed into the open interior 84 defined by the diffuser 80. Typically, the light strip sections are designed such that the end light strip section includes a series of wires that can be connected to a supply of electricity. These wires are then connected to the supply of electricity and the accent lighting assembly 78 is mounted to the light base trim member 26 in the manner shown in FIG. 5. As illustrated in FIG. 5, the intersection between the projection wall 92 and the back wall 86 is positioned within the open receiving cavity 64 until this intersection contacts the vertical lip 66. Once in this position, the accent lighting assembly 78 is pushed upward. as shown by arrow 108. During this upward, rotating movement, the lower corner 110 passes over the support shoulder 68 such that the entire lighting assembly 78 snaps into the mounted position shown in FIG. 3. When the lighting assembly 78 is in the mounted position shown in FIG. 3, the LED lights 96 direct light in the desired direction as illustrated.

In the embodiments shown in FIGS. 3 and 4, the lighting base trim member 26 is shown mounted to the exterior side of the glass wall panel 12 that may define hallways within a building. On the opposite, interior side of the wall panel, the embodiment shown in FIG. 3 includes the decorative base trim member 48. However, it should be understood that the lighting base trim member 26 could be utilized on both sides of the wall panel depending upon user requirements.

As can be understood in the Figures, the individual lower trim sections shown in FIG. 1 can be connected across the entire length of a series of adjacent wall sections and the individual LED light strips contained within the diffuser can be connected together in series to eliminate long sections of the lower trim. Further, if a business owner desires not to include the accent lighting, the base trim sections including the accent lighting can be replaced by base trim sections that do not include any lighting. In this manner, the owner can configure the wall panel system to either include or not include the accent lighting created through use of the base trim sections of the present disclosure.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A demountable modular wall system for use in a building having a floor and a ceiling, comprising:

a series of individual wall panels each having a top end and a bottom end;

a lighting base trim member positioned to conceal a space between the bottom end of at least one of the series of individual wall panels and the floor;

a floor channel mounted to the floor, wherein the lighting base trim member is secured to the floor channel;

a decorative base trim member positioned on an opposite side of the wall panel from the lighting base trim, wherein the decorative base trim member is secured to the floor channel; and an accent lighting assembly mounted to the lighting base trim member and operable to generate accent light directed away from the wall panel and onto the floor.

2. The demountable modular wall system of claim 1 wherein the base trim member includes a receiving cavity that receives the accent lighting assembly.

3. The demountable modular wall system of claim 2 wherein the receiving cavity includes a generally horizontal flange that partially defines the receiving cavity and a support shoulder that retains the accent lighting assembly within the receiving cavity.

4. The demountable modular wall system of claim 1 wherein the accent lighting assembly includes a diffuser having an open interior and a light strip contained within the open interior.

5. The demountable modular wall system of claim 4 wherein the light strip includes a plurality of spaced LED lights.

6. The demountable modular wall system of claim 4 wherein the diffuser includes a curved projection wall, wherein the plurality of LED lights are positioned to face the curved projection wall.

7. The demountable modular wall system of claim 6 wherein the diffuser is formed from transparent extruded plastic.

8. The demountable modular wall system of claim 1 further comprising a decorative base trim member positioned on an opposite side of the wall panel from the lighting base trim member.

* * * * *